US005480035A

United States Patent [19]

Smith

[11] Patent Number: 5,480,035

[45] Date of Patent: Jan. 2, 1996

[54] DISHWASHER RACK WITH ADJUSTABLE SHELF

[75] Inventor: John M. Smith, Louisville, Ky.

[73] Assignee: General Electric Company, Louisville, Ky.

[21] Appl. No.: 192,367

[22] Filed: Feb. 7, 1994

[51] Int. Cl.[6] ..... A47F 7/00

[52] U.S. Cl. ..... 211/41; 211/181; 211/168

[58] Field of Search ..... 211/41, 71, 74, 211/80, 181, 150, 168, 169.1; 312/311, 312

[56] References Cited

U.S. PATENT DOCUMENTS

| | | | |
|---|---|---|---|
| 3,752,322 | 8/1973 | Fiocca et al. | 211/41 |
| 4,046,261 | 9/1977 | Yake | 211/41 |
| 4,097,099 | 6/1978 | Spiegel | 312/311 |
| 4,606,464 | 8/1986 | Jordan et al. | 211/41 |
| 4,917,248 | 4/1990 | Friskney | 211/41 |
| 5,205,419 | 4/1993 | Purtilo | 211/41 |
| 5,351,837 | 10/1994 | Smith | 211/41 |

FOREIGN PATENT DOCUMENTS 3022484 1/1982 Germany .

*Primary Examiner*—Alvin C. Chin-Shue
*Assistant Examiner*—Sarah L. Purol
*Attorney, Agent, or Firm*—H. Neil Houser

[57] ABSTRACT

An open dishrack for a dishwasher has opposite sides formed of spaced apart elongated coated wires. A vertically adjustable shelf extends between the opposite sides. A pair of support plates include snap fittings which engage the wires to mount the plates on the sides in a facing relationship. Each plate includes an upper and a lower hub aligned with the corresponding hub of the other plate. The shelf includes projecting fingers which are received in a selected pair of hubs to rotatably mount the shelf in either an upper or a lower position. Each plate also includes a rib associated with each of its hubs to support the shelf in a generally horizontal orientation when the shelf is mounted in that hub. Each plate also includes a rib positioned to support the shelf in a generally vertical position when the shelf is mounted in the lower hubs. Each plate includes a cup or trunion positioned above its upper hub and a rod is received in the cups and extends across the dish rack to provide lateral support to items on the shelf and to support the shelf in a generally vertical orientation when the shelf is in its upper position.

6 Claims, 2 Drawing Sheets

DISHWASHER RACK WITH ADJUSTABLE SHELF

BACKGROUND OF THE INVENTION

This invention relates to a dishwasher rack and, more particularly, to dishracks for use in domestic dishwashers. Such dishwashers are designed primarily for use in the home and normally are of a front opening configuration. Normally such dishwashers have an upper and a lower dishrack to support various items to be washed. A typical family often has many cups, glasses and similar items to be washed and such items tend to have many sizes, including many different heights. Thus it has become common practice to include a pivotal shelf along one edge of one dishrack, normally along a side of the upper rack, to provide flexibility in loading such items. When there are many short items, the shelf is placed in its generally horizontal orientation and short items are placed on the rack under the shelf and other short items are placed on the shelf. This increases the effective space of the rack. When not needed the shelf may be pivoted to its generally vertical orientation out of the way of the rack interior so that taller items can be placed on the bottom of the rack.

Such shelves are very useful but do not provide optimum usage of the available space in the dishrack. For example, if the shelf is positioned about half way up the side of the dishrack, then a row of short items, like cups or short glasses for example, can be placed under the shelf and another row of similar items can be placed on the shelf. However, with such a positioning of the shelf, even medium height glasses are too tall to be safely washed if placed on the shelf. On the other hand, if the shelf is placed closer to the top of the dishrack, taller items can be placed under the shelf. However, it limits use of the shelf itself to items like small bowls and serving or cooking utensils such as spatulas.

The present invention provides a dishrack with a shelf which is vertically adjustable for increased flexibility of use. The shelf has both an upper and a lower position and is supported in both a generally horizontal and in a generally vertical orientation when in each of its positions, The shelf is selectively moveable between its upper and its lower positions so that the user has the ability to adjust the position of the rack to best accommodate each particular load to be washed.

The shelf is supported in the dishrack by plates or end caps which snap fit on the wires forming the side of the rack. The plates are symmetric about their horizontal center line so that the same design plate can be used on both sides of the dishrack.

SUMMARY OF THE INVENTION

In accordance with one embodiment of the present invention an open dishrack has opposite sides comprised of spaced apart elongated members. An article supporting shelf extends between the sides and includes oppositely projecting fingers. A pair of support plates or end caps include snap attachment means mounting the plates on the opposite sides in facing relationship. Each plate includes an upper and a lower hub aligned with the corresponding hubs of the other plate. The projecting fingers of the shelf are rotatably mounted in a selected corresponding pair of the hubs to selectively place the shelf in either an upper or a lower position. Each plate includes means to support the shelf in a generally horizontal orientation and in a generally vertical orientation when the shelf is in either its upper or its lower position.

In the exemplification embodiment, the means for supporting the shelf in most of its orientations comprises tabs or ribs formed as part of the plates. In addition each plate includes a cup positioned above its upper hub and aligned with the cup of the other plate. A rod extends between the cups so that the cup and rod assembly provides lateral support for items placed on the shelf and provides support for the shelf when it is in its generally vertical orientation in its upper position.

DETAILED DESCRIPTION OF PREFERRED EMBODIMENT

Figure 2:
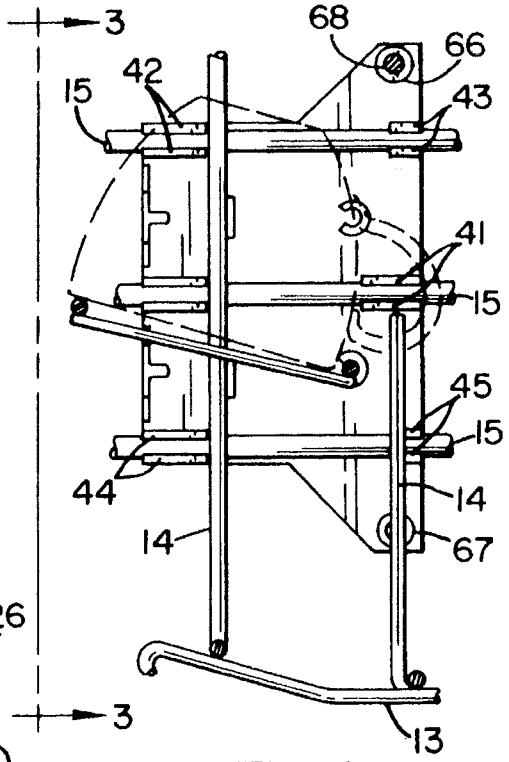
FIG. 2 is a fragmentary side elevation view as seen along line 2—2 in FIG. 1.
Figure 3:
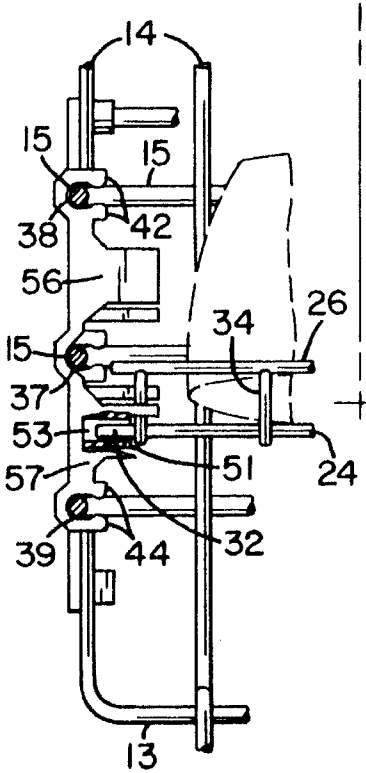
FIG. 3 is a fragmentary elevation view as seen along line 3—3 in FIG. 2.
Figure 1:
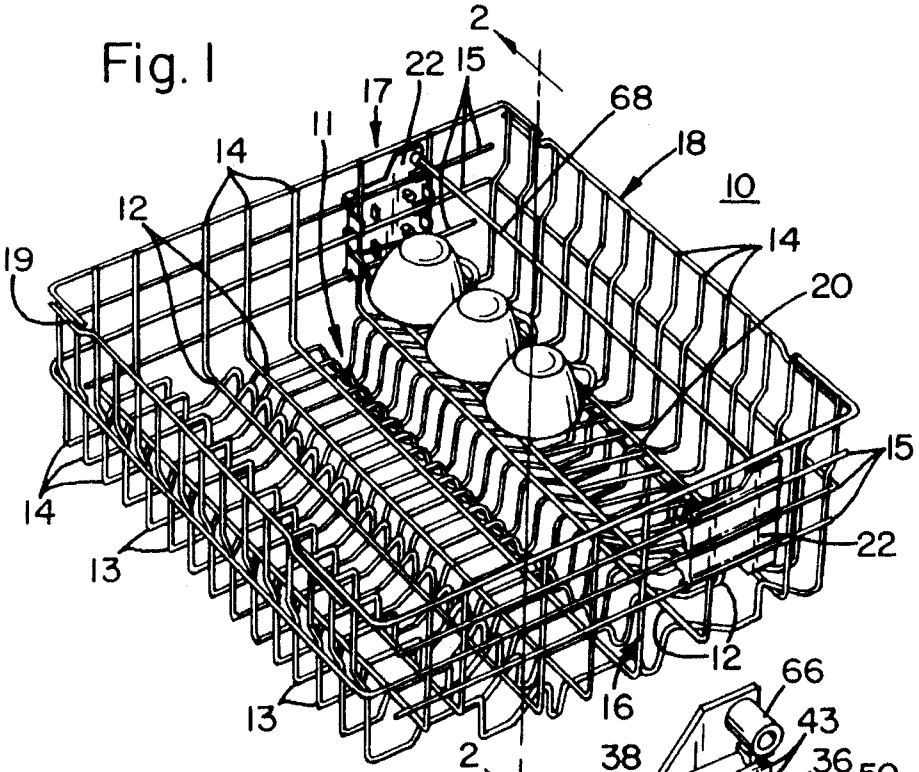
FIG. 1 is a perspective view of a dishrack with an adjustable shelf assembly incorporating an exemplification embodiment of the present invention.

Referring now to the drawings, and particularly to FIG. 1, there is shown an upper dishrack 10 for use in an automatic domestic dishwasher. The rack 10 conveniently is constructed from a plurality of heavy metal wires or rods which are arranged in a perpendicular crossing pattern on the bottom 11 of the rack. More particularly, wires 12 run front-to-back of the bottom 11 while wires 13 run side-to-side of the bottom. The intersections of the wires 12 and 13 are joined, as by welding, to form a strong, rigid open mesh bottom 11 of the rack 10. The distal end portions of the wires 12 and 13 are bent upward at generally ninety degrees to form upstanding fingers 14 defining the side walls of the rack. Additional wires 15 extend around the periphery of the side walls and are joined with the fingers 14, as by welding, to give the sides of the rack a strong, rigid open mesh construction. Thus the fingers 14 and wire bands 15 form the side walls with elongated, spaced apart members extending at right angles to each other. More particularly the sides of the rack 10 are spaced apart opposed front 16 and back 17 walls joined by spaced apart, opposed right and left lateral walls 18,19. Conveniently after the dishrack 10 is formed it is coated with a wear resistant plastic material, such as nylon for example, to protect the wires from rusting and cushion items placed in the rack.

Figure 5:
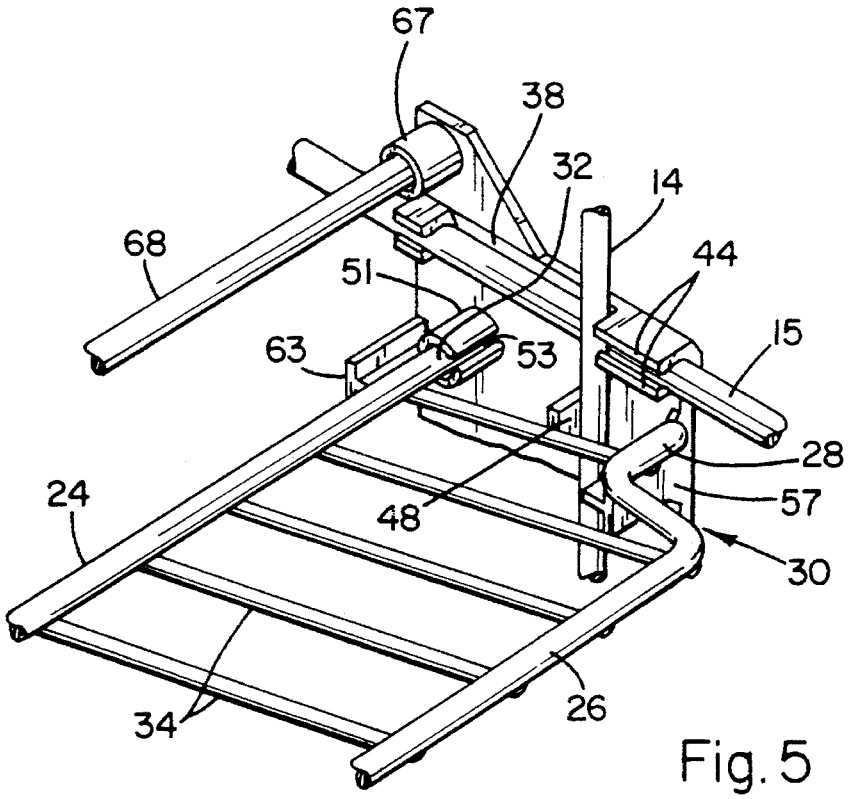
FIG. 5 is a fragmentary perspective view of a plate and shelf, with the shelf in its upper position and generally horizontal orientation.

A shelf 20 is mounted between a pair of opposite side walls, in the illustration between front wall 16 and rear or back wall 17, by means of a pair of plates or end caps 22. As is best seen in FIGS. 1 and 5, the shelf 20 includes an elongated rear wire or rod 24 and a front wire or rod 26 which extends parallel to and spaced from the rear wire. Each end portion of the front wire 26 is bent, as seen at 28, to form an offset or recess 30 at the front corner of the shelf 20 and then join the rear wall 24. The distal ends of the rear wire 24 extend beyond the junction with front wire 26 and form oppositely projecting fingers, one of which is shown at 32. Additional wires or rods 34 extend between and are welded to the front and rear wires 26,24 and the entire shelf conveniently is coated with a suitable plastic material. Only one end of the shelf 20 has been shown as it will be understood that the other end is a mirror image thereof.

Figure 4:
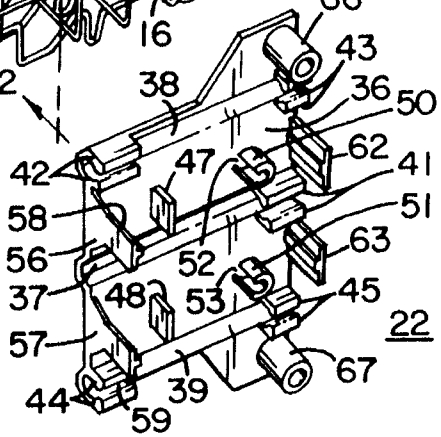
FIG. 4 is a perspective view of a plate used to mount the adjustable shelf in the dishrack of FIG. 1.

As best seen in FIG. 4, each plate or end cap 22 is formed in a symmetric configuration so that the same design plate can be used on both of a pair of opposite sides of the dishrack to support the shelf 20. Preferably the plates are molded as an unitary structure from a suitable plastic material, such as polypropylene for example, that has sufficient structural strength and will withstand the harsh environment in an automatic dishwasher. The plate 22 is formed with a generally planar base 36 having an elongated recess 37 extending across its mid-line in a generally horizontal direction (as seen when the plate is mounted on the dishrack). Additional recesses 38 and 39 extend across the upper and lower portions of the base 36, parallel to and spaced equally from the recess 37. More specifically the recesses have the same spacing as the wires 15 which extend across the front and rear walls 16,17 of dishrack 10. In this way, when a plate is mounted on the rack, the wires 15 are received in corresponding ones of the recesses 37–39. A pair of resilient fingers 41 project out of the base 36 adjacent one end of the recess 37 and form a snap attachment means for gripping the wire 15 received in the recess 37. Similarly, two pairs of spring fingers 42 and 43 project from the base 36 adjacent each end of recess 38 and two pairs of spring fingers 44,45 project form the base 36 adjacent each end of the recess 39. These spring fingers form additional snap attachment means which grip the wires 15 received in the recesses 38,39. In this manner the plate is easily mounted on and firmly held on the wires 15 but can be removed if desired, all without the necessity of any special tools. A tab 47 projects from the base 36 slightly below the inner end of the pair of fingers 42 and a similar tab 48 projects from the base 36 slightly above the inner end of the pair of fingers 44. Each of the tabs 47,48 is offset inward of the inner end of the adjacent finger pairs a distance substantially equal to the thickness of one of the upstanding rods or fingers 14 of the dishrack side, including its nylon coating. When the plate is mounted on the dishrack side, an upstanding rod 14 is received between the inner ends of the finger pairs 42,44 and the tabs 47,48. In this way the plate is fixed laterally of the dishrack side. The mounting relationship of these parts is illustrated in FIG. 5.

Hubs 50,51 extend inwardly of the base 36 at equal distances above and below the center recess 37. Each hub has an inside diameter just larger than the outside diameter of the fingers 32 at the ends of the rear wire 24 of shelf 20 and has a longitudinal split 52,53 respectively. In this way the fingers 32 can be inserted into aligned facing hubs 50,51 of a pair of facing plates 22 while the plates are mounted on the opposite sides of the dishrack 10. The hubs 50,51 then rotatably support the fingers so that the shelf 20 can be moved between a generally horizontal orientation and a generally vertical orientation.

Ribs 56,57 project from the base 36 directly opposite the hubs 50,51 respectively and are symmetrical with the hubs to support the shelf in its generally horizontal orientation. For example, viewing FIG. 4, a shelf 20 mounted in the hub 50 will be supported in a generally horizontal orientation by the upper edge 58 of rib 56 and by the opposite edge 59 of the rib 57 of the plate on the opposite side of the dishrack 10. Similarly hub 51 and the corresponding edge of rib 57 will support, in a generally horizontal orientation, a shelf mounted in the hub 51 of plate 22. With this arrangement, the hubs 50,51 will mount a shelf 20 on a pair of plates or end caps 22 in either an upper or a lower position and the ribs 56,57 will support the shelf in a generally horizontal orientation when it is in either position.

An additional pair of ribs 62,63 project from the base 36 along the edge opposite ribs 56,57; that is adjacent the hubs 50,51 respectively. Viewing FIG. 4, when a shelf is mounted in hub 51, the rib 62 will support the shelf when it is rotated to its generally vertical orientation. Similarly, when the plate 22 is upside-down on the opposite side of the dishrack, a shelf mounted in the hub 50 will be supported in its generally vertical orientation by rib 63. In summary, when a shelf is mounted in the lower hub of a plate, the rib 62, 63 adjacent the upper hub supports the shelf in its generally vertical orientation.

Referring to the orientation of plate 22 in FIG. 4, a mounting cup 66 projects from the base 36 above the recess 38 and a mounting cup 67 projects from the base below recess 39. An elongated member 68, conveniently in the form of a coated wire or rod, extends across the dishrack and is mounted in the cups 66,67. The cup and rod assembly serves a dual purpose. First, when the shelf is in its generally horizontal orientation, the cup and rod assembly will provide lateral support to any tall items placed upon the shelf. Second, when the shelf is in its upper position, the cups 66,67 and rod 68 will support the shelf in its generally vertical orientation.

Figure 6:
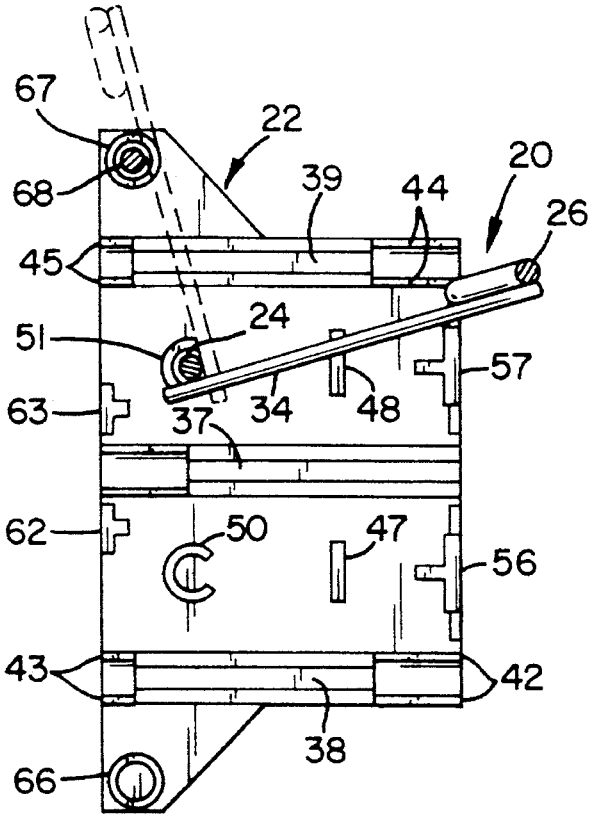
FIG. 6 is a side view of a plate and shelf, illustrating the shelf in both of its orientations when in its upper position.
Figure 7:
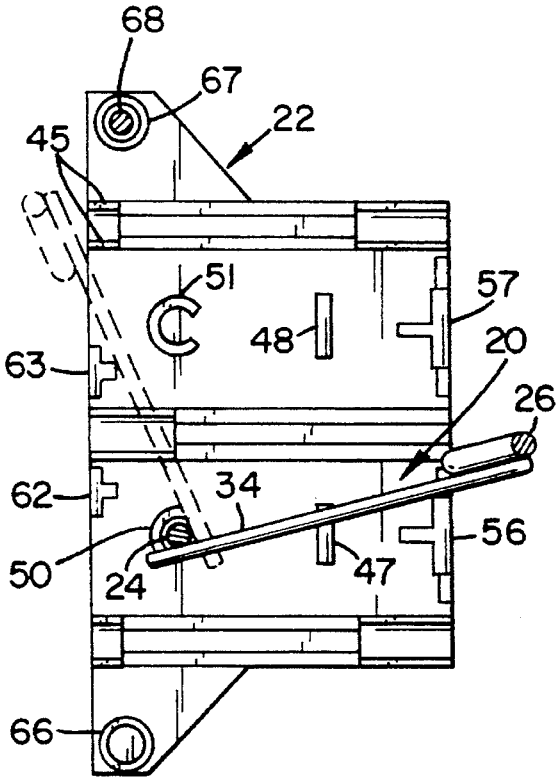
FIG. 7 is a view similar to FIG. 6, but with the shelf in its lower position.

Referring now to FIGS. 6 and 7, there is shown in somewhat schematic form a shelf in its upper position (FIG. 6) and in its lower position (FIG. 7), supported in both its generally horizontal orientation (solid line) and in its generally vertical orientation (dashed line). It will be recognized that, in each of these Fig's, the plate 22 is inverted from the orientation of FIG. 5. Referring now to FIG. 6, when the shelf 20 is mounted in upper hub 51 and is generally horizontal, it is supported by the upper edge of rib 57. When it is generally vertical, it is supported by the assembly of cups 66,67 and rod 68. Referring now to FIG. 7, when the shelf 20 is mounted in lower hub 50 and is generally horizontal, it is supported by rib 56. When it is generally vertical it is supported by rib 62. The notch or recess 30 in the front corner of the shelf (see FIG. 5) enables the shelf to pass by rib 57 as it is moved between its horizontal and vertical orientations. It will be understood that in each configuration, the other end of the shelf is mounted and supported in a like manner.

As seen in FIGS. 6 and 7, in the generally horizontal orientation of shelf 20, the front wire 26 is slightly above the rear wire 24 so that the shelf is actually tilted slightly toward the side of the dishrack. This provides more stability for articles placed on the shelf as they tend to rest against either the side of the dishrack or the rod 68. Similarly, in its generally vertical orientation, the shelf has passed slightly beyond true vertical and rests against the assembly of rod 68 and cups 66,67. This provides a more stable placement of the shelf and it will not be dislodged by the action of the wash fluid.

While a specific embodiment of the present invention has been illustrated and described herein, it is realized that modifications and changes will occur to those skilled in the art to which it pertains. It is therefore to be understood that the appended claims cover all such modifications and changes as fall within the true spirit and scope of the invention.

What is claimed is:

1. An apparatus for supporting articles in a dishwasher, including:

an open dishrack having opposite sides comprising spaced apart elongated members;

an article supporting open shelf extending between said opposite sides and including oppositely projecting fingers;

a pair of shelf supporting plates including snap attachment means mounting said plates in facing relationship on selected members of said opposite dishrack sides;

each of said plates including an upper and a lower hub positioned in facing relationship with said upper and lower hubs respectively of said other plate to rotatably receive said shelf fingers for mounting said shelf in a selected one of an upper and a lower position; and support means, including said plates, for selectively supporting said shelf in a generally horizontal configuration and in a generally vertical configuration when said shelf is in its upper position and when said shelf is in its lower position.

2. An apparatus as set forth in claim 1, wherein: at least one of each facing pair of hubs is split to assist mounting said shelf fingers in that pair of hubs.

3. An apparatus as set forth in claim 1; further including an elongated rod spanning said opposite dishrack sides and wherein each of said plates includes a cup positioned above its upper hub and receiving one end of said rod; said rod and cups supporting said shelf in its generally vertical orientation when in its upper position and providing lateral support for articles supported on said shelf when said shelf is in a generally horizontal orientation.

4. An apparatus as set forth in claim 3, wherein: each of said plates includes inwardly projecting ribs forming said means for supporting said shelf in its generally vertical orientation when in its lower position and for supporting said shelf in its generally horizontal orientations when in each of its upper and lower positions.

5. An apparatus as set forth in claim 4, wherein: each of said plates also includes another cup positioned below its lower hub and wherein said hubs, cups and projections of each of said plates are arranged symmetrically about a horizontal center line of that plate so that plates of the same design may be used with both sides of said dishrack.

6. An apparatus as set forth in claim 1, wherein;

said elongated members of each of said opposite dishrack sides include at least one generally horizontal member and at least one generally vertical member;

said attachment means includes a pair of resilient fingers formed integrally with each of said plates and fitting around said at least one horizontal member; and each of said plates further includes a tab spaced from said pair of resilient fingers a distance sufficient to confine said at least one vertical member there between;

whereby each of said plates is firmly positioned relative to the associated dishrack side.

* * * * *